US010043474B2

(12) United States Patent
Zhao et al.

(10) Patent No.: US 10,043,474 B2
(45) Date of Patent: Aug. 7, 2018

(54) GATE DRIVING CIRCUIT ON ARRAY SUBSTRATE AND LIQUID CRYSTAL DISPLAY (LCD) USING THE SAME

(71) Applicant: WUHAN CHINA STAR OPTOELECTRONICS TECHNOLOGY CO., LTD., Wuhan, Hubei (CN)

(72) Inventors: Mang Zhao, Hubei (CN); Yafeng Li, Hubei (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 310 days.

(21) Appl. No.: 14/916,343

(22) PCT Filed: Feb. 24, 2016

(86) PCT No.: PCT/CN2016/074392
§ 371 (c)(1),
(2) Date: Mar. 3, 2016

(87) PCT Pub. No.: WO2017/117844
PCT Pub. Date: Jul. 13, 2017

(65) Prior Publication Data

US 2018/0061346 A1 Mar. 1, 2018

(30) Foreign Application Priority Data

Jan. 7, 2016 (CN) ..... 2016 1 0008000

(51) Int. Cl.
*G09G 3/36* (2006.01)

(52) U.S. Cl.
CPC ... *G09G 3/3677* (2013.01); *G09G 2310/0243* (2013.01); *G09G 2310/0289* (2013.01); *G09G 2310/08* (2013.01)

(58) Field of Classification Search
CPC ..... G09G 3/3677; G09G 2310/08; G09G 2310/0243; G09G 2310/0289
See application file for complete search history.

(56) References Cited

U.S. PATENT DOCUMENTS

2013/0136224 A1* 5/2013 Qing ..... G11C 19/28 377/64
2015/0228354 A1* 8/2015 Qing ..... G11C 19/28 345/100

(Continued)

*Primary Examiner* — Abhishek Sarma
(74) *Attorney, Agent, or Firm* — Ladas & Parry LLP

(57) ABSTRACT

A gate driving circuit disposed on an array substrate and an LCD using the same are described. The gate driving circuit on the array substrate comprises a plurality of sequentially connected gate driving units. The gate driving circuit unit comprises an input module, a reset module, a latch module and a signal processing module. The signal processing module receives the current inverse stage-transmitting signal XQ(N), the low voltage signal, a second clock signal and a third clock signal to control on/off statuses of two transistors by the current stage-transmitting signal Q(N) so that the two transistors forms Nth gate signal G(N) and gate signal (N+1)th based on the second clock signal and the third clock signal. The present invention utilizes less clock signals and transistors, which is favorable to the narrower LCD's frame design and solves the problem of manufacturing process restriction of the LCD panel.

7 Claims, 6 Drawing Sheets

(56) References Cited

U.S. PATENT DOCUMENTS

| | | | | |
|---|---|---|---|---|
| 2017/0162152 | A1* | 6/2017 | Zhao | G09G 3/3677 |
| 2017/0162153 | A1* | 6/2017 | Zhao | G09G 3/3677 |
| 2017/0169780 | A1* | 6/2017 | Zhao | G09G 3/3677 |

* cited by examiner

GATE DRIVING CIRCUIT ON ARRAY SUBSTRATE AND LIQUID CRYSTAL DISPLAY (LCD) USING THE SAME

BACKGROUND OF THE INVENTION

Field of Invention

The present invention relates to a technical field of a liquid crystal display (LCD), and more particularly to a gate driving circuit disposed on an array substrate and an LCD using the same.

Description of Prior Art

Since the LCD is provided with the features of low radiation, small size and low power consumption for consumers, therefore, the conventional display unit with cathode ray tube is increasingly replaced by the LCD. An LCD panel is widely used in communication products including a notebook computer, a personal digital assistant (PDA), a flat panel television and mobile phone.

The gate driver on array (GOA) is an array substrate process by integrating a column gate driving circuit into the array substrate of thin film transistor (TFT) LCD to implement one kind of display technique by scanning the gate electrodes line-by-line. In the conventional GOA design structure, more and more clock signal wires and transistors must be used, which is unfavorable to narrower LCD's frame. Furthermore, regarding to the circuit design of GOA in the conventional narrower LCD's frame, the multiple stages of gate driving signals are only formed by reducing the line width of single stage GOA. However, the reduction of GOA circuits will be extremely difficult due to the process restrictions of display panel. Consequently, there is a need to develop a novel gate driving circuit to solve the problems of the conventional technique.

SUMMARY OF THE INVENTION

Therefore, one objective of the present invention is to provide a gate driving circuit on an array substrate and an LCD using the same to utilize less clock signals and transistors by way of an input module, a latch module and a signal processing signal, which is favorable to narrower LCD's frame design and solve the problem of manufacturing process restriction of the LCD panel.

Based on the above objective, the present invention sets forth a gate driving circuit on an array substrate and an LCD using the same according to a first embodiment of the present invention. The gate driving circuit which is disposed on an array substrate of a liquid crystal display (LCD), wherein the gate driving circuit on the array substrate comprises a plurality of sequentially connected gate driving units, the gate driving circuit unit comprising: an input module, for receiving a previous stage-transmitting signal Q(N−1), a previous inverse stage-transmitting signal XQ(N−1) and a low voltage signal to generate a current stage transition signal TP(N) and a current stage-transmitting signal Q(N) wherein the serial number "N" is a positive integer; a reset module connected to the input module, for receiving a reset signal, a high voltage signal and the low voltage signal to allow the current stage transition signal TP(N) and the current stage-transmitting signal Q(N) to be reset by the reset signal in an initial status, wherein the reset module generates a control signal based on the high voltage signal and the current stage transition signal; a latch module connected to the reset module, for receiving the control signal, a first clock signal and the high voltage signal, wherein the latch module generates a current inverse stage-transmitting signal XQ(N) according to the control signal and the first clock signal; and a signal processing module connected to the latch module, for receiving the current inverse stage-transmitting signal XQ(N), the low voltage signal, a second clock signal and a third clock signal to control on/off statuses of two transistors by the current stage-transmitting signal Q(N) so that the two transistors forms Nth gate signal G(N) and gate signal (N+1)th based on the second clock signal and the third clock signal.

In one embodiment, at least three stages of sequentially connected gate driving circuits on the array substrate comprises a previous stage gate driving circuit, a current stage gate driving circuit and a next stage gate driving circuit; wherein the current stage gate driving circuit generates a previous stage-transmitting signal Q(N−1) and a previous inverse stage-transmitting signal XQ(N−1), and the latch module of the next stage gate driving circuit further comprises a second inverter having a second input terminal and a second output terminal; wherein the second input terminal receives the first clock signal to generate an inverse first clock signal and the second output terminal outputs the inverse first clock signal to the tenth source electrode and the eleventh source electrode.

In a second embodiment of the present invention, the signal processing module of the gate driving circuit further comprises: a third inverter comprising a third input terminal and a third output terminal wherein the third input terminal receives the current inverse stage-transmitting signal XQ(N) for generating the current stage-transmitting signal Q(N); a first logic unit connected to the third inverter and comprising a first NAND and a plurality of third set of inverters connected to the first NAND wherein two input terminals of the first NAND receives the current stage-transmitting signal Q(N) and the second clock signal respectively to allow the third set of inverter to generate Nth gate signal G(N); and a second logic unit comprising a second NAND and a plurality of fourth set of inverters connected to the second NAND wherein two input terminals of the second NAND receives the current stage-transmitting signal Q(N) and the third clock signal respectively to allow the fourth set of inverter to generate (N+1)th gate signal G(N+1).

In a third embodiment of the present invention, an array substrate with a gate driving circuit, which is used in a liquid crystal display (LCD), and the gate driving circuit comprises: an input module, for receiving a previous stage-transmitting signal Q(N−1), a previous inverse stage-transmitting signal XQ(N−1) and a low voltage signal to generate a current stage transition signal TP(N) and a current stage-transmitting signal Q(N) wherein the serial number "N" is a positive integer, and the previous stage-transmitting signal Q(N−1) is a starting signal (STV) on the array substrate with the gate driving circuit; a reset module connected to the input module, for receiving a reset signal, a high voltage signal and the low voltage signal to allow the current stage transition signal TP(N) and the current stage-transmitting signal Q(N) to be reset by the reset signal in an initial status, wherein the reset module generates a control signal based on the high voltage signal and the current stage transition signal; a latch module connected to the reset module, for receiving the control signal, a first clock signal and the high voltage signal, wherein the latch module generates a current inverse stage-transmitting signal XQ(N) according to the control signal and the first clock signal; and a signal processing module connected to the latch module, for receiving the current inverse stage-transmitting signal XQ(N), the low voltage signal, a second clock signal and a third clock signal to control on/off statuses of a plurality of pairs of transistors by the current stage-transmitting signal Q(N) so that the first pair of transistors forms a first stage gate signal G(1) based on the second clock signal and forms the rest of pairs of transistors forms gate signals from G(2) to G(N) based on and the third clock signal.

DETAILED DESCRIPTION OF THE PREFERRED EMBODIMENTS

Figure 1A:
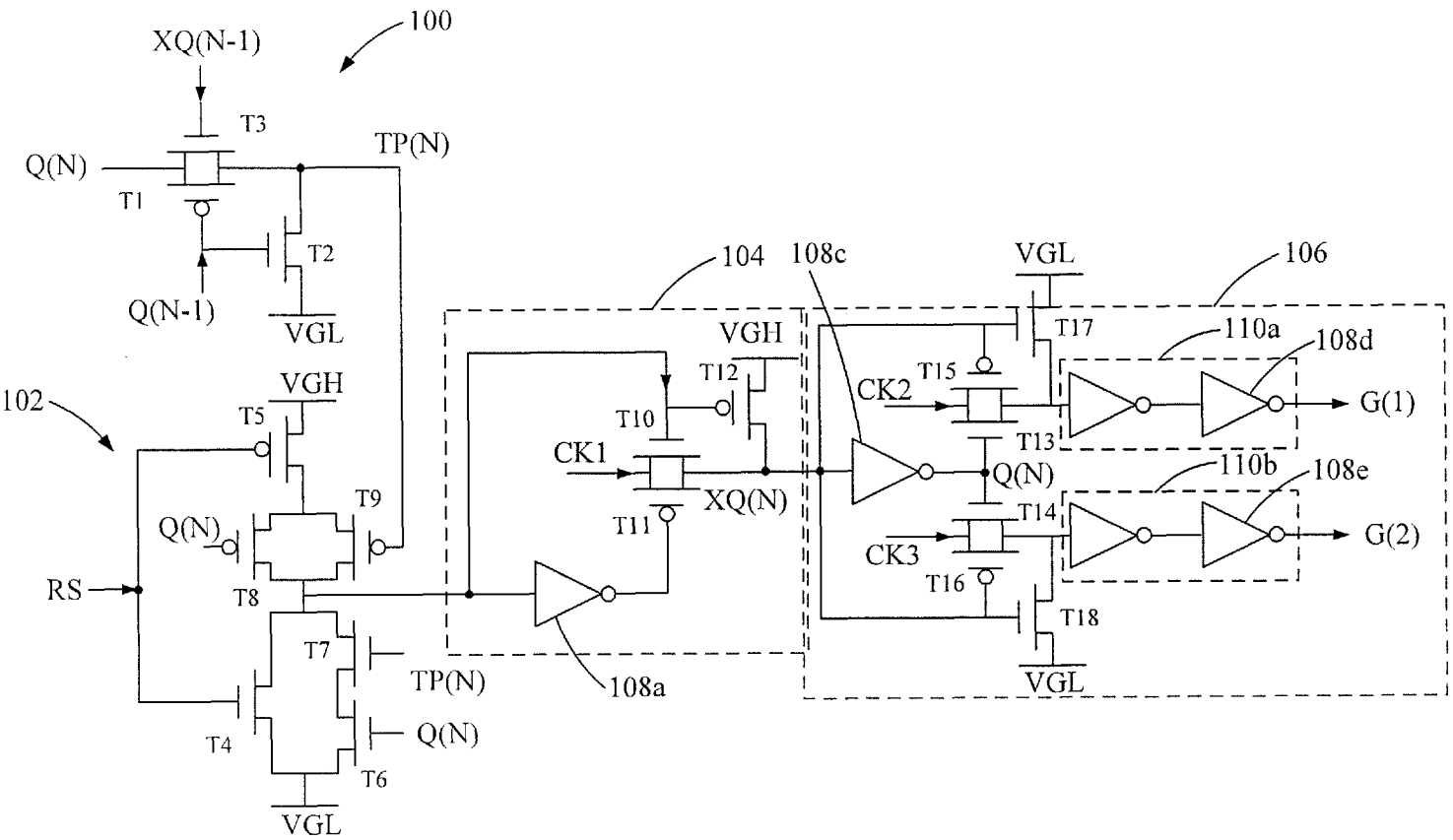
FIGS. 1A and 1B are schematic views of a gate driving circuit on an array substrate according to a first embodiment of the present invention.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto. In the drawings, the same reference symbol represents the same or a similar component.

Figure 1B:
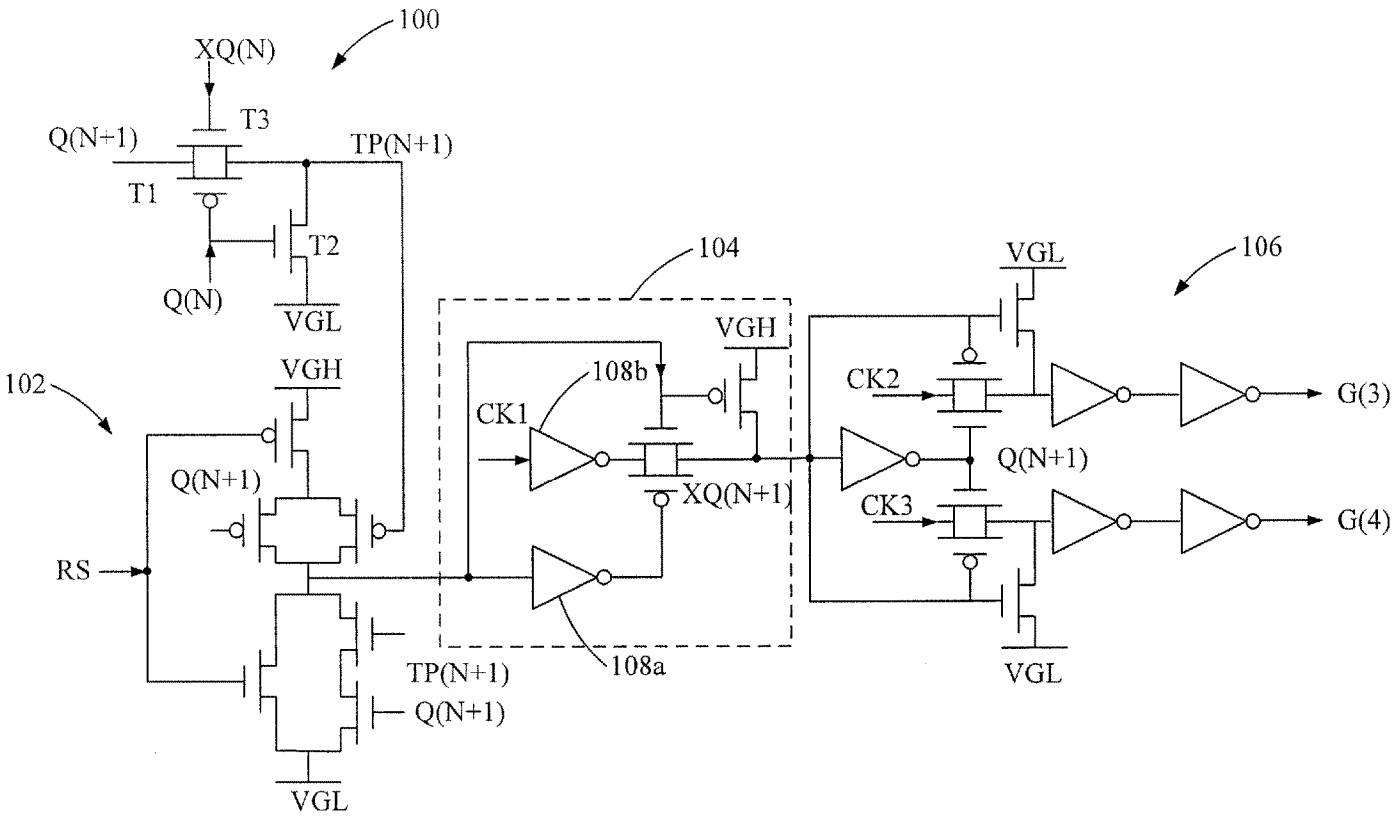

Please refer to FIGS. 1A and 1B, which are schematic views of a gate driving circuit on an array substrate according to a first embodiment of the present invention. The gate driving circuit is disposed on an array substrate of a liquid crystal display (LCD) wherein the gate driving circuit on the array substrate comprises a plurality of sequentially connected gate driving units. Each gate driving unit comprises an input module 100, a reset module 102, a latch module 104 and a signal processing module 106 wherein the input module 100 is connected to the reset module 102, the reset module 102 is connected to the latch module 104, and the latch module 104 is connected to the signal processing module 106.

Figure 2:
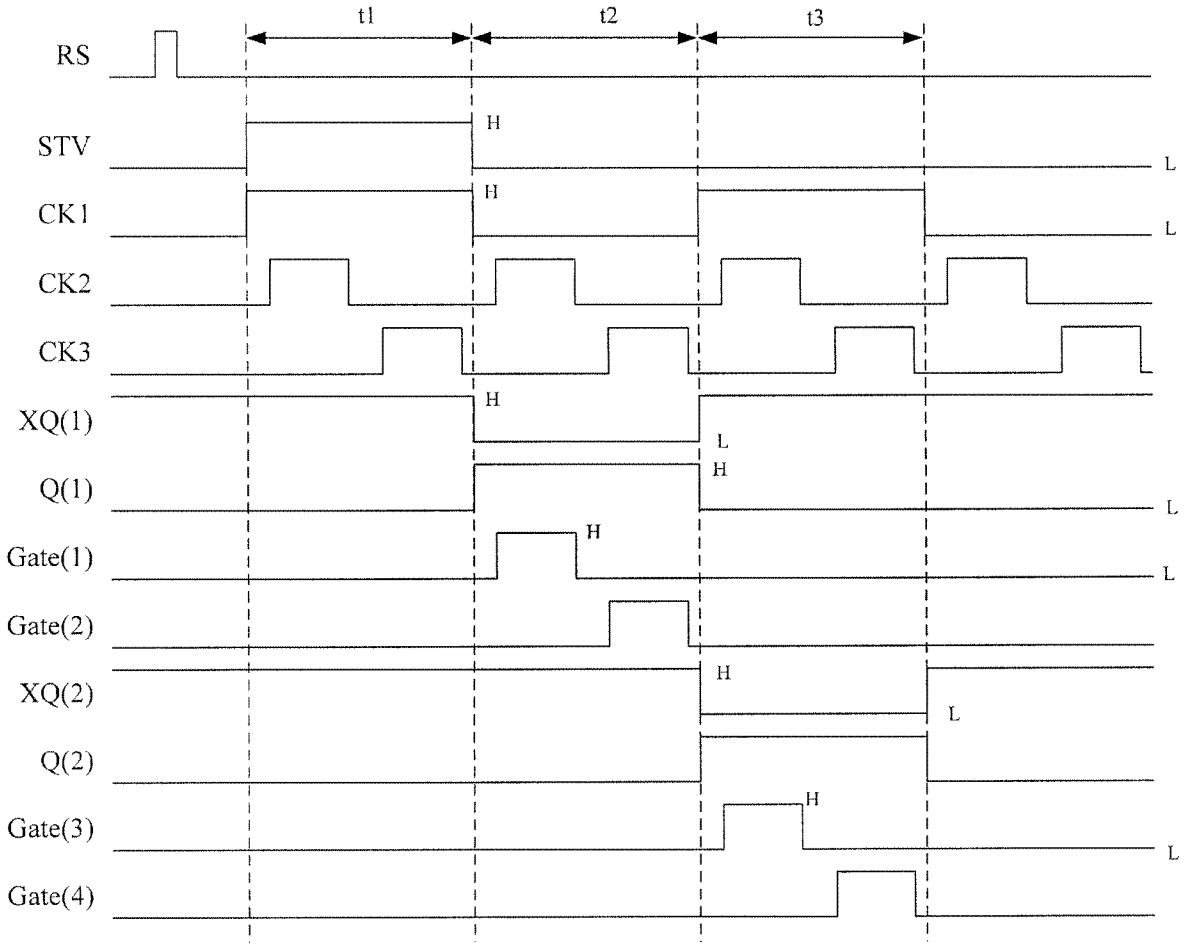
FIG. 2 is a schematic waveform timing view of the gate driving circuit on the array substrate according to one embodiment of the present invention.

In FIG. 1A, the input module 100 receives a previous stage-transmitting signal Q(N−1), a previous inverse stage-transmitting signal XQ(N−1) and a low voltage signal VGL for generating a current stage transition signal TP(N) and a current stage-transmitting signal Q(N) wherein the serial number "N" is a positive integer. The reset module 102 receives a reset signal SRE, a high voltage signal VGH, e.g. positive voltage signal, and the low voltage signal VGL, e.g. negative voltage signal, so that the current stage transition signal TP(N) and the current stage-transmitting signal Q(N) is reset by the signal RS in the initial status, as shown in FIG. 2, and the reset module 102 generates a control signal SC based on the high voltage signal VGH and the current stage transition signal TP(N).

As shown in FIG. 1A, the latch module 104 receives the control signal SC, a first clock signal CK1 and the high voltage signal VGH, and the latch module 104 generates a current inverse stage-transmitting signal XQ(N) according to the control signal SC and the first clock signal CK1. The signal processing module 106 receives the current inverse stage-transmitting signal XQ(N), the low voltage signal VGL, a second clock signal CK2 and a third clock signal CK3 for controlling on/off statuses of two transistors by the current stage-transmitting signal Q(N) so that the two transistors forms Nth gate signal G(N) and gate signal (N+1)th based on the second clock signal CK2 and the third clock signal CK3.

In FIG. 1A, the input module 100 comprises a first transistor T1, a second transistor T2 and a third transistor T3 wherein the first transistor T1 comprises a first source electrode, a first gate electrode and a first drain electrode, the second transistor T2 comprises a second source electrode, a second gate electrode and a second drain electrode, and the third transistor T3 comprises a third source electrode, a third gate electrode and a third drain electrode. The first source electrode connected to the third source electrode receives the current stage-transmitting signal Q(N). The first drain electrode, the second source electrode and the third drain electrode are connected together for receiving the current stage transition signal TP(N). The first gate electrode is connected to the second gate electrode for receiving the previous stage-transmitting signal Q(N−1). The third gate electrode receives the previous inverse stage-transmitting signal XQ(N−1). The second drain electrode receives the low voltage signal VGL.

As shown in FIG. 1A, the reset module 102 comprises a fourth transistor T4, a fifth transistor T5, a sixth transistor T6, a seventh transistor T7, an eighth transistor T8 and a ninth transistor T9 wherein the fourth transistor T4 comprises a fourth source electrode, a fourth gate electrode and a fourth drain electrode, the fifth transistor T5 comprises a fifth source electrode, a fifth gate electrode and a fifth drain electrode, the sixth transistor T6 comprises a sixth source electrode, a sixth gate electrode and a sixth drain electrode, the seventh transistor T7 comprises a seventh source electrode, a seventh gate electrode and a seventh drain electrode, the eighth transistor T8 comprises an eighth source electrode, an eighth gate electrode and an eighth drain electrode, and the ninth transistor T9 comprises a ninth source electrode, a ninth gate electrode and a ninth drain electrode. The fourth gate electrode is connected to the fifth gate electrode for receiving the reset signal. The sixth and eighth gate electrodes receives the current stage-transmitting signal Q(N). The seventh and ninth gate electrodes receives the current stage transition signal TP(N). The fifth source electrode receives the high voltage signal VGH. The fourth drain electrode is connected to the sixth drain electrode for receiving low voltage signal VGL. The fourth source electrode, seventh source electrode, eighth drain electrode and ninth drain electrode are connected together for outputting the control signal. The fifth drain electrode, the eight drain electrode and the ninth source electrode are connected together.

In FIG. 1A, the latch module 104 comprises a first inverter 108*a*, a tenth transistor T10, an eleventh transistor T11 and a twelfth transistor T12. The first inverter 108*a* comprises a first input terminal and a first output terminal for receiving the control signal to form an inverse control signal. The tenth transistor T10 comprises a tenth source electrode, a tenth gate electrode and a tenth drain electrode, the eleventh transistor T11 comprises an eleventh source electrode, an eleventh gate electrode and an eleventh drain electrode, and the twelfth transistor T12 comprises a twelfth source electrode, a twelfth gate electrode and a twelfth drain electrode.

The first input terminal is connected to the tenth gate electrode and the twelfth gate electrode for receiving the control signal SC and the first output terminal is used to output the inverse control signal to the eleventh gate electrode. The twelfth transistor T12 receives the first clock signal CK1. The tenth drain electrode, eleventh drain electrode and the twelfth drain electrode are connected together to generate the current inverse stage-transmitting signal XQ(N) and the twelfth source electrode receives the high voltage signal VGH.

Three stages of sequentially connected gate driving circuits on the array substrate comprises a previous stage gate driving circuit (not shown), a current stage gate driving circuit (as shown in FIG. 1A) and a next stage gate driving circuit (as shown in FIG. 1B) wherein the current stage gate driving circuit and the next stage gate driving circuit are depicted. The current stage gate driving circuit generates a previous stage-transmitting signal Q(N−1) and a previous inverse stage-transmitting signal XQ(N−1) to be inputted to the current stage gate driving circuit (as shown in FIG. 1A). The latch module of the next stage gate driving circuit further comprises a second inverter 108*b* connected to the tenth source electrode and the eleventh source electrode wherein the second inverter 108*b* receives the first clock signal CK1 to generate an inverse first clock signal to be outputted to the tenth source electrode and the eleventh source electrode. It should be noted that the difference between the current stage gate driving circuit (as shown in FIG. 1A) and the next stage gate driving circuit (as shown in FIG. 1B) is the second inverter 108*b* and thus the rest of components is the same.

As shown in FIG. 1A, the signal processing module 106 comprises a third inverter 108*c*, a thirteenth transistor T13, a fourteenth transistor T14, a fifteenth transistor T15, a sixteenth transistor T16, a seventeenth transistor T17, an eighteenth transistor T18, a first set of inverter 110*a* and a second set of inverter 110*b*. The third inverter 108*c* comprises a third input terminal and a third output terminal wherein the third input terminal receives the current inverse stage-transmitting signal XQ(N) for generating the current stage-transmitting signal Q(N). The thirteenth transistor T13 comprises a thirteenth source electrode, a thirteenth gate electrode and a thirteenth drain electrode, the fourteenth transistor T14 comprises a fourteenth source electrode, a fourteenth gate electrode and a fourteenth drain electrode, the fifteenth transistor T15 comprises a fifteenth source electrode, a fifteenth gate electrode and a fifteenth drain electrode, the sixteenth transistor T16 comprises a sixteenth source electrode, a sixteenth gate electrode and a sixteenth drain electrode, the seventeenth transistor T17 comprises a seventeenth source electrode, a seventeenth gate electrode and a seventeenth drain electrode, and the eighteenth transistor T18 comprises an eighteenth source electrode, an eighteenth gate electrode and an eighteenth drain electrode. The first set of inverter 110*a* comprises a plurality of sequentially connected fourth inverter 108*d* and the first set of inverter 110*a* is connected to the thirteenth transistor T13, the fifteenth transistor T15 and the seventeenth transistor T17. The second set of inverter 110*b* comprises a plurality of sequentially connected fifth inverter 108*e* and the second set of inverter 110*b* is connected to the fourteenth transistor T14, the sixteenth transistor T16 and the eighteenth transistor T18.

The third input terminal is connected to the fifteenth gate electrode, sixteenth gate electrode, seventeenth gate electrode and eighteenth gate electrode and the third output terminal outputs the current stage-transmitting signal Q(N) to the thirteenth gate electrode and the fourteenth gate electrode. The thirteenth source electrode is connected to the fifteenth source electrode for receiving the second clock signal CK2 to generate Nth gate signal G(N). The fourteenth source electrode is connected to the sixteenth source electrode for receiving the third clock signal CK3 to generate (N+1)th gate signal G(N+1). The thirteenth drain electrode, fifteenth drain electrode, seventeenth drain electrode and the first set of inverter 110*a* are connected together so that the first set of inverter 110*a* outputs the Nth gate signal G(N). The fourteenth drain electrode, sixteenth drain electrode, eighteenth drain electrode and the second set of inverter 110*b* are connected together so that the second set of inverter 110*b* outputs the (N+1)th gate signal G(N+1). The seventeenth drain electrode and eighteenth drain electrode receive the low voltage signal VGL.

Please continuously refer to FIGS. 1A-1B and FIG. 2. FIG. 2 is a schematic waveform timing view of the gate driving circuit on the array substrate according to one embodiment of the present invention. For an example of N=1 during the time period t1, when the previous stage-transmitting signal Q(0), e.g. a starting signal (STV), is generated, the transition signal TP(1), which is the same as the waveform of Q(1), of the current stage gate driving circuit becomes a low voltage level "L" and the control signal SC is in a high voltage level (not shown). Meanwhile, when the tenth transistor T10 and the eleventh transistor T11 of the latch module 104 turn on, the current inverse stage-transmitting signal XQ(1) is in a high voltage level "H". In one embodiment, the starting signal STV is an active signal of one display frame of LCD for starting one display frame.

When entering the time period t2 after the previous stage-transmitting signal Q(0) during the time period t1 is generated, the first clock signal CK1 becomes a low voltage level and the current inverse stage-transmitting signal XQ(1) is in a low voltage level "L" wherein the current stage-transmitting signal Q(1) becomes a high voltage level. Meanwhile, when the thirteenth transistor T13 to sixteenth transistor T16 of the signal processing module 106 in the current stage gate driving circuit turn on, the first stage gate signal G(1) and the second stage gate signal G(2) are generated due to both the second clock signal CK2 and the third clock signal CK3.

When the current stage-transmitting signal Q(1) with the high voltage level is formed during the time period t2, the transition signal TP(2), which is the same as the waveform of Q(2), of the next stage gate driving circuit (as shown in FIG. 1B) becomes a low voltage level "L" and the control signal SC is in a high voltage level (not shown). When the tenth transistor T10 and eleventh transistor T11 of the latch module 104 in the next stage gate driving circuit turn on, the first clock signal CK1 passes the second inverter 108*b* and the current inverse stage-transmitting signal XQ(1) with a low voltage level is outputted.

When entering the time period t3 after the current stage-transmitting signal Q(1) during the time period t2 is generated, the first clock signal CK1 becomes a high voltage level and the next inverse stage-transmitting signal XQ(2) is in a low voltage level wherein the next stage-transmitting signal Q(2) becomes a high voltage level. Meanwhile, when the thirteenth transistor T13 to sixteenth transistor T16 of the signal processing module 106 in the next stage gate driving circuit turn on, the third stage gate signal G(3) and the fourth stage gate signal G(4) arc generated due to both the second clock signal CK2 and the third clock signal CK3.

Figure 3A:
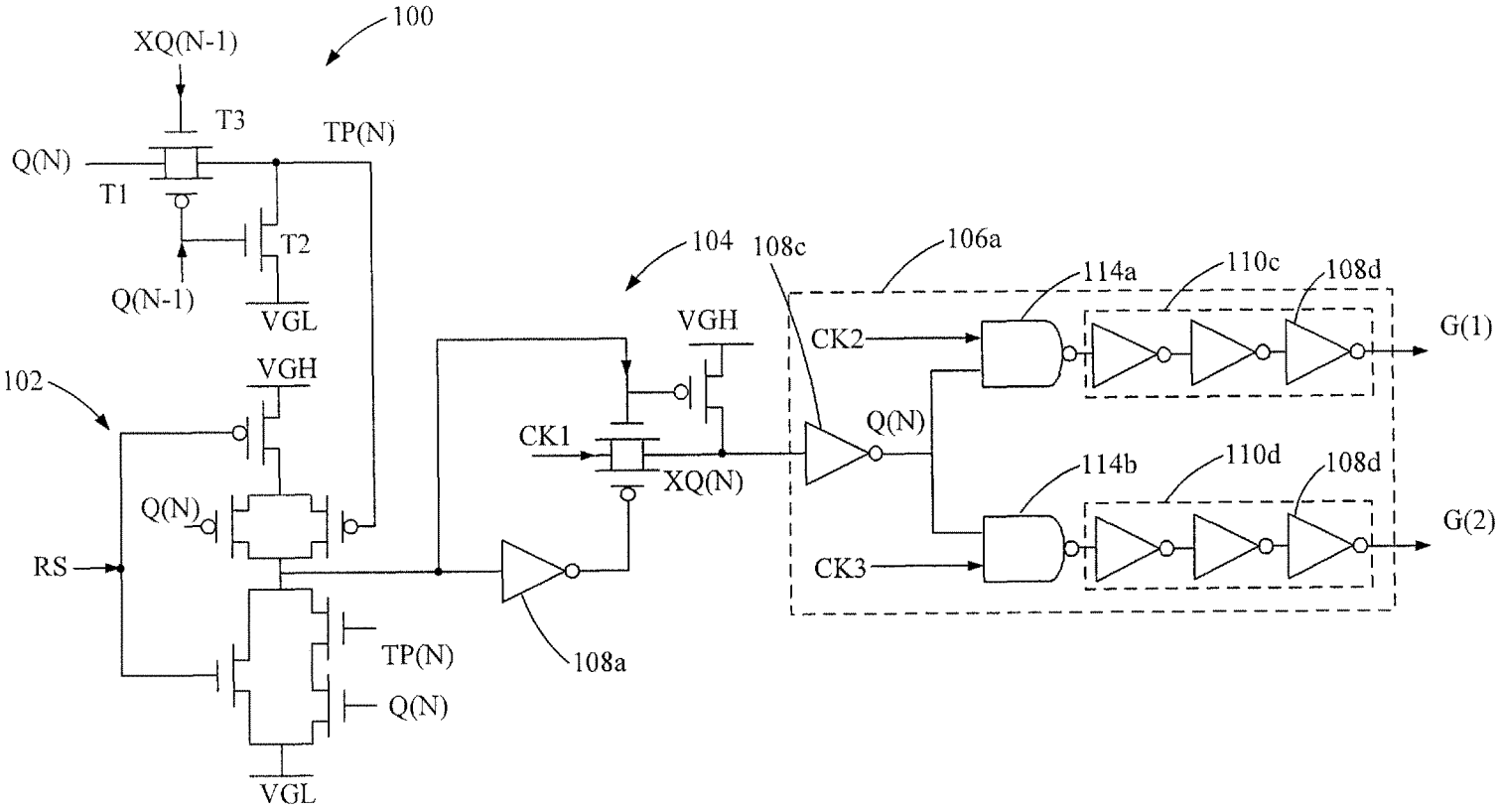
FIGS. 3A and 3B are schematic views of a gate driving circuit on an array substrate according to a second embodiment of the present invention.
Figure 3B:
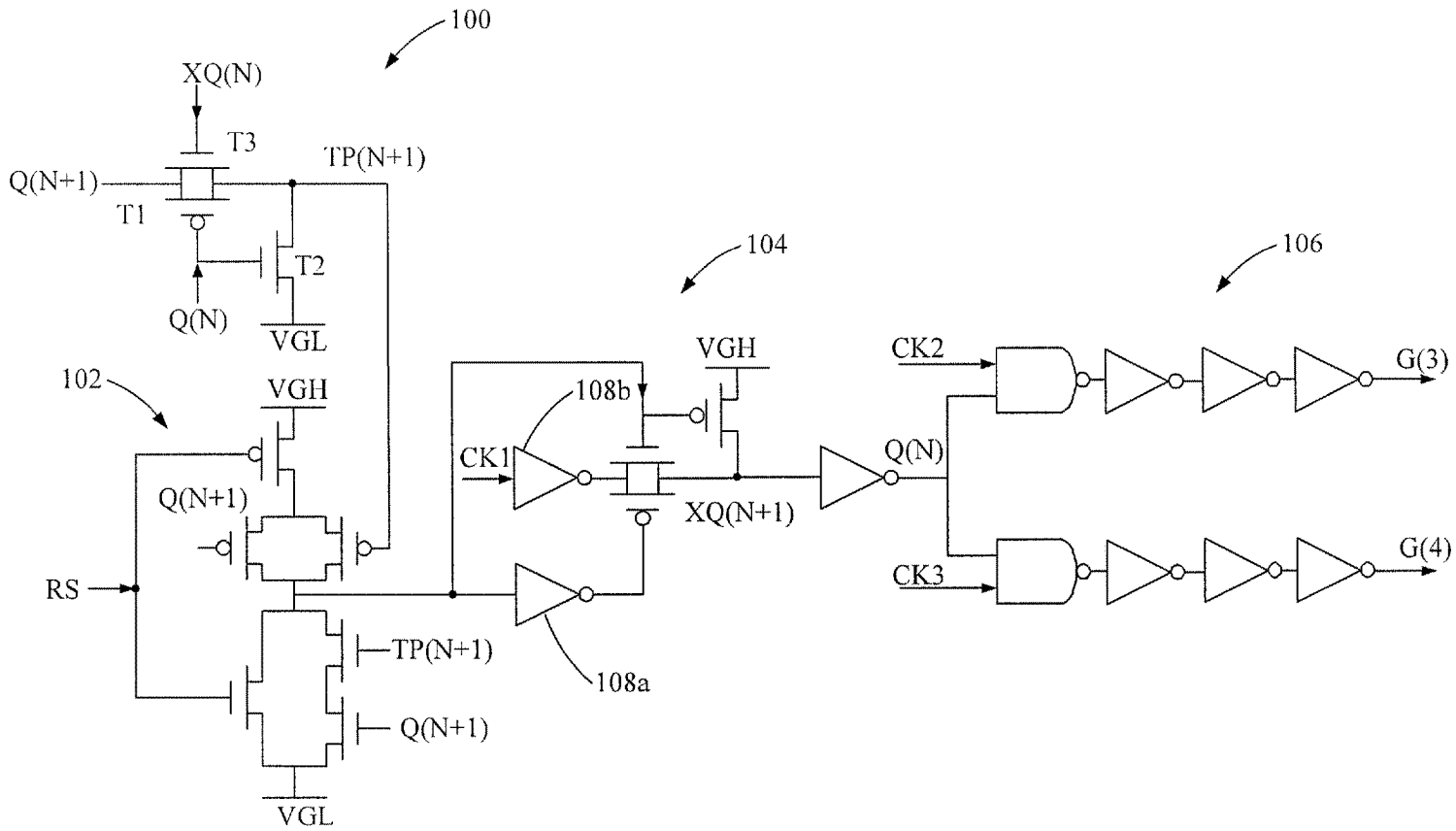

Please refer to FIGS. 3A and 3B, which are schematic views of a gate driving circuit on an array substrate according to a second embodiment of the present invention. The difference between the gate driving circuit in FIGS. 1A-1B and the gate driving circuit in FIGS. 3A-3B is the signal processing module 106*a* wherein the signal processing module 106*a* in FIGS. 3A-3B comprises a third inverter 108*c*, a first logic unit 112*a* and a second logic unit 112*b*. The third inverter 108*c* comprises a third input terminal and a third output terminal wherein the third input terminal receives the current inverse stage-transmitting signal XQ(N) for generating the current stage-transmitting signal Q(N). The first logic unit 112*a* comprises a first NAND 114*a* and a plurality of third set of inverters 110*c* connected to the first NAND 114*a* wherein two input terminals of the first NAND 114*a* receives the current stage-transmitting signal Q(N) and the second clock signal CK2 respectively to allow the third set of inverter 110*c* to generate Nth gate signal G(N). The second logic unit 112*b* comprises a second NAND 114*b* and a plurality of fourth set of inverters 110*d* connected to the second NAND 114*b* wherein two input terminals of the second NAND 114*b* receives the current stage-transmitting signal Q(N) and the third clock signal CK3 respectively to allow the fourth set of inverter 110*d* to generate (N+1)th gate signal G(N+1). The third set of inverter 110*d* and fourth set of inverter 110*d* respectively comprise a plurality of fourth inverters 108*d*.

Figure 4:
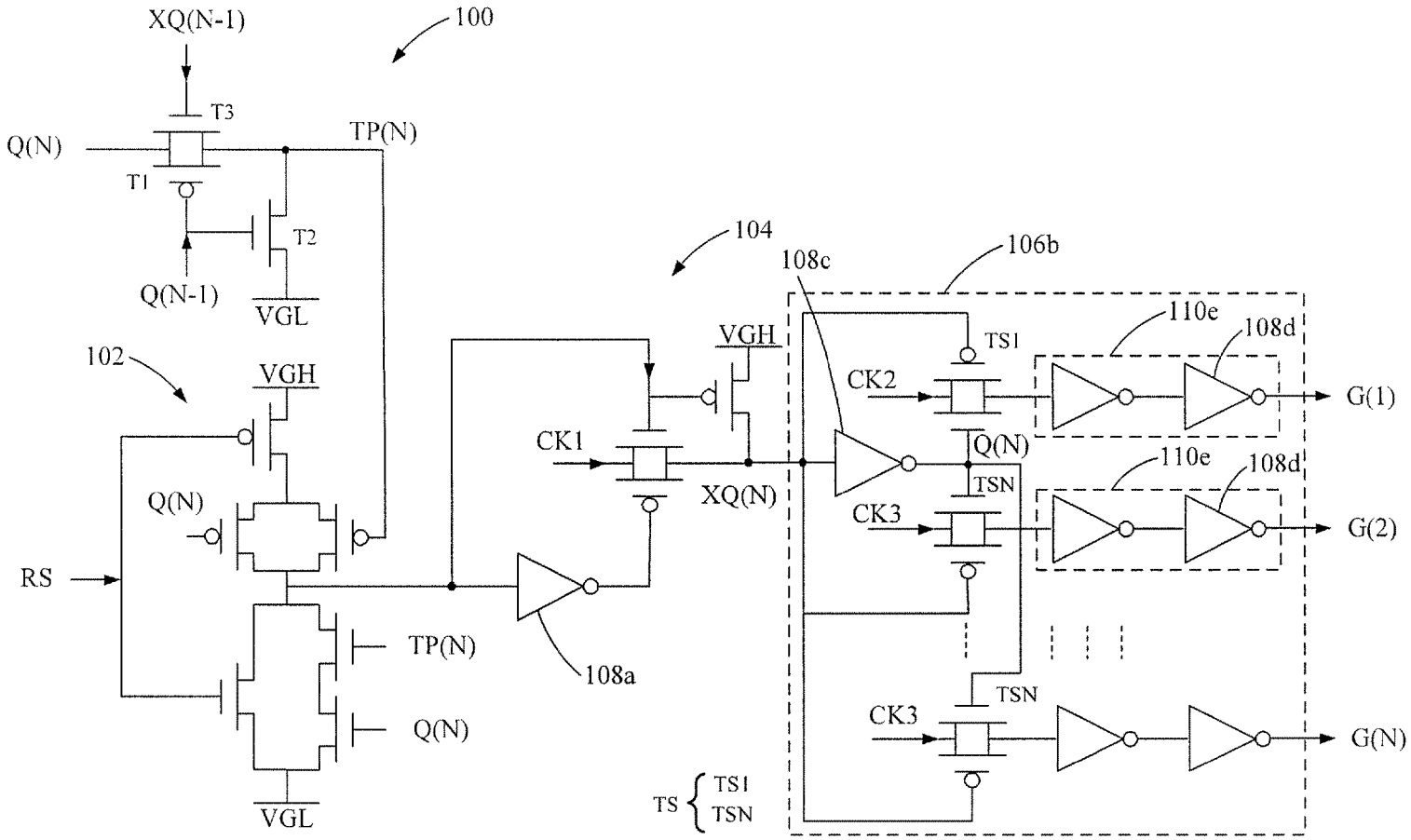
FIG. 4 is a schematic view of a gate driving circuit on an array substrate according to a third embodiment of the present invention.

Please refer to FIG. 4, which is a schematic view of a gate driving circuit on an array substrate according to a third embodiment of the present invention. The difference between the gate driving circuit in FIG. 1A and the gate driving circuit in FIG. 4 is that only one gate driving unit is disposed in the gate driving circuit in FIG. 4 wherein the signal processing module 106*b* in FIG. 4 is different from the signal processing module 106 in FIG. 1A. The gate driving circuit is disposed on an array substrate of a liquid crystal display (LCD) comprises an input module 100, a reset module 102, a latch module 104 and a signal processing module 106*b* wherein the input module 100 is connected to the reset module 102, the reset module 102 is connected to the latch module 104, and the latch module 104 is connected to the signal processing module 106*b*. The input module 100 receives a previous stage-transmitting signal Q(N−1), a previous inverse stage-transmitting signal XQ(N−1) and a low voltage signal VGL for generating a current stage transition signal TP(N) and a current stage-transmitting signal Q(N) wherein the serial number "N" is a positive integer and the previous stage-transmitting signal Q(N−1) is a starting signal STV on the array substrate on the gate driving circuit for displaying one display frame.

The reset module 102 receives a reset signal SRE, a high voltage signal VGH and the low voltage signal VGL so that the current stage transition signal TP(N) and the current stage-transmitting signal Q(N) is reset by the signal RS in the initial status, and the reset module 102 generates a control signal SC based on the high voltage signal VGH and the current stage transition signal TP(N). The latch module 104 receives the control signal SC, a first clock signal CK1 and the high voltage signal VGH, and the latch module 104 generates a current inverse stage-transmitting signal XQ(N) according to the control signal SC and the first clock signal CK1. The signal processing module 106*b* controls the on/off statuses of a set of transistors TS, e.g. a pair of thirteenth transistor T13 and fifteenth transistor in FIG. 1A, by the current stage-transmitting signal Q(N) so that the first pair of transistors TS1 forms first stage gate signal G(1) based on the second clock signal CK2 and forms the rest of pairs of transistors TSN forms gate signals from G(2) to G(N) based on and the third clock signal CK3.

In one embodiment of FIG. 4, the signal processing module 106*b* comprises a third inverter 108*c*, a plurality of pairs of transistors TS and a plurality of sets of inverter units 110*e*. The third inverter 108*c* comprises a third input terminal and a third output terminal wherein the third input terminal receives the current inverse stage-transmitting signal XQ(N) for generating the current stage-transmitting signal Q(N). Each pair of transistor TS comprises a first type of transistor and a second type of transistor wherein each of the first type of transistor and a second type of transistor comprises a source electrode, a gate electrode and a drain electrode. The sets of inverter units 110*e* are connected to the pairs of transistors TS respectively wherein each set of inverter units 110*e* comprises a plurality of sequentially connected fourth inverters 108*d*. The third input terminal of third inverter 108*c* transmits the current inverse stage-transmitting signal XQ(N) to each gate electrode of each second type of transistor and the third output terminal of third inverter 108*c* transmits the current stage-transmitting signal Q(N) to each gate electrode of each first type of transistor. Two source electrodes of the first type of transistor and the second type of transistor in each pair of transistors are connected together, and two drain electrodes of the first type of transistor and the second type of transistor in each pair of transistors and each set of inverter units 110*e* are connected together. The first pair of transistor is controlled by the second clock signal CK2 to allow the first set of inverter units 110*e* to generate the first gate signal G(1) and the rest of pairs of transistors are controlled by the third clock signals CK3 to allow the rest of sets of inverter units 110*e* to sequentially generate the gate signals from G(2) to G(N). In the present invention, the inverters are used to increase the driving capacity of the gate driving signal of the gate driver in order to reduce the RC delay.

The present invention provides an LCD which employs the above-mentioned gate driving circuit according to a second embodiment.

According to aforementioned descriptions, the gate driving circuit disposed on an array substrate and LCD using the same in the present invention utilizes less clock signals and transistors by way of an input module, a latch module and a signal processing signal, which is favorable to narrower LCD's frame design and solve the problem of manufacturing process restriction of the LCD panel.

As is understood by a person skilled in the art, the foregoing preferred embodiments of the present invention are illustrative rather than limiting of the present invention. It is intended that they cover various modifications and similar arrangements be included within the spirit and scope of the present invention, the scope of which should be accorded the broadest interpretation so as to encompass all such modifications and similar structures.

What is claimed is:

1. A gate driving circuit which is disposed on an array substrate of a liquid crystal display (LCD), wherein the gate driving circuit on the array substrate comprises a plurality of sequentially connected gate driving units, the gate driving circuit unit comprising:

an input module, for receiving a previous stage-transmitting signal Q(N−1), a previous inverse stage-transmitting signal XQ(N−1) and a low voltage signal to generate a current stage transition signal TP(N) and a current stage-transmitting signal Q(N) wherein the serial number "N" is a positive integer;

a reset module connected to the input module, for receiving a reset signal, a high voltage signal and the low voltage signal to allow the current stage transition signal TP(N) and the current stage-transmitting signal Q(N) to be reset by the reset signal in an initial status, wherein the reset module generates a control signal based on the high voltage signal and the current stage transition signal;

a latch module connected to the reset module, for receiving the control signal, a first clock signal and the high voltage signal, wherein the latch module generates a current inverse stage-transmitting signal XQ(N) according to the control signal and the first clock signal; and a signal processing module connected to the latch module, for receiving the current inverse stage-transmitting signal XQ(N), the low voltage signal, a second clock signal and a third clock signal to control on/off statuses of two transistors by the current stage-transmitting signal Q(N) so that the two transistors forms Nth gate signal G(N) and gate signal (N+1)th based on the second clock signal and the third clock signal.

2. The gate driving circuit of claim 1, wherein the input module further comprises:

a first transistor comprising a first source electrode, a first gate electrode and a first drain electrode;

a second transistor comprising a second source electrode, a second gate electrode and a second drain electrode; and a third transistor comprising a third source electrode, a third gate electrode and a third drain electrode;

wherein the first source electrode is connected to the third source electrode for receiving the current stage-transmitting signal Q(N);

wherein the first drain electrode, the second source electrode and the third drain electrode are connected together for receiving the current stage transition signal TP(N);

wherein the first gate electrode is connected to the second gate electrode for receiving the previous stage-transmitting signal Q(N−1), the third gate electrode receives the previous inverse stage-transmitting signal XQ(N−1), and the second drain electrode receives the low voltage signal.

3. The gate driving circuit of claim 1, wherein the reset module further comprises:

a fourth transistor comprising a fourth source electrode, a fourth gate electrode and a fourth drain electrode;

a fifth transistor comprising a fifth source electrode, a fifth gate electrode and a fifth drain electrode;

a sixth transistor comprising a sixth source electrode, a sixth gate electrode and a sixth drain electrode;

a seventh transistor comprising a seventh source electrode, a seventh gate electrode and a seventh drain electrode;

a eighth transistor comprising an eighth source electrode, an eighth gate electrode and an eighth drain electrode; and a ninth transistor comprising a ninth source electrode, a ninth gate electrode and a ninth drain electrode;

wherein the fourth gate electrode is connected to the fifth gate electrode for receiving the reset signal, the sixth and eighth gate electrodes receives the current stage-transmitting signal Q(N), the seventh and ninth gate electrodes receives the current stage transition signal TP(N), the fifth source electrode receives the high voltage signal, and the fourth drain electrode is connected to the sixth drain electrode for receiving the low voltage signal;

wherein the fourth source electrode, the seventh source electrode, the eighth drain electrode and the ninth drain electrode are connected together for outputting the control signal;

wherein the fifth drain electrode, the eight drain electrode and the ninth source electrode are connected together.

4. The gate driving circuit of claim 1, wherein the latch module further comprises:

a first inverter comprising a first input terminal and a first output terminal for receiving the control signal to form an inverse control signal;

a tenth transistor comprising a tenth source electrode, a tenth gate electrode and a tenth drain electrode;

an eleventh transistor comprising an eleventh source electrode, an eleventh gate electrode and an eleventh drain electrode; and a twelfth transistor comprising a twelfth source electrode, a twelfth gate electrode and a twelfth drain electrode;

wherein the first input terminal is connected to the tenth gate electrode and the twelfth gate electrode for receiving the control signal and the first output terminal is used to output the inverse control signal to the eleventh gate electrode, and the twelfth transistor receives the first clock signal;

wherein the tenth drain electrode, eleventh drain electrode and the twelfth drain electrode are connected together to generate the current inverse stage-transmitting signal XQ(N) and the twelfth source electrode receives the high voltage signal.

5. The gate driving circuit of claim 4, wherein at least three stages of sequentially connected gate driving circuits on the array substrate comprises a previous stage gate driving circuit, a current stage gate driving circuit and a next stage gate driving circuit;

wherein the current stage gate driving circuit generates a previous stage-transmitting signal Q(N−1) and a previous inverse stage-transmitting signal XQ(N−1), and the latch module of the next stage gate driving circuit further comprises a second inverter having a second input terminal and a second output terminal;

wherein the second input terminal receives the first clock signal to generate an inverse first clock signal and the second output terminal outputs the inverse first clock signal to the tenth source electrode and the eleventh source electrode.

6. The gate driving circuit of claim 1, wherein the signal processing module further comprises:

a third inverter comprising a third input terminal and a third output terminal wherein the third input terminal receives the current inverse stage-transmitting signal XQ(N) for generating the current stage-transmitting signal Q(N);

a thirteenth transistor comprising a thirteenth source electrode, a thirteenth gate electrode and a thirteenth drain electrode;

a fourteenth transistor comprising a fourteenth source electrode, a fourteenth gate electrode and a fourteenth drain electrode;

a fifteenth transistor comprising a fifteenth source electrode, a fifteenth gate electrode and a fifteenth drain electrode;

a sixteenth transistor comprising a sixteenth source electrode, a sixteenth gate electrode and a sixteenth drain electrode;

a seventeenth transistor comprising a seventeenth source electrode, a seventeenth gate electrode and a seventeenth drain electrode;

an eighteenth transistor comprising an eighteenth source electrode, an eighteenth gate electrode and an eighteenth drain electrode;

a first set of inverter comprising a plurality of sequentially connected fourth inverter wherein the first set of inverter is connected to the thirteenth transistor, the fifteenth transistor and the seventeenth transistor; and a second set of inverter comprising a plurality of sequentially connected fifth inverter wherein the second set of inverter is connected to the fourteenth transistor, the sixteenth transistor and the eighteenth transistor;

wherein the third input terminal is connected to the fifteenth gate electrode, sixteenth gate electrode, seventeenth gate electrode and eighteenth gate electrode and the third output terminal outputs the current stage-transmitting signal Q(N) to the thirteenth gate electrode and the fourteenth gate electrode;

wherein the thirteenth source electrode is connected to the fifteenth source electrode for receiving the second clock signal to generate Nth gate signal G(N), and the fourteenth source electrode is connected to the sixteenth source electrode for receiving the third clock signal to generate (N+1)th gate signal G(N+1);

wherein the thirteenth drain electrode, fifteenth drain electrode, seventeenth drain electrode and the first set of inverter are connected together so that the first set of inverter outputs the Nth gate signal G(N);

wherein the fourteenth drain electrode, the sixteenth drain electrode, the eighteenth drain electrode and the second set of inverter are connected together so that the second set of inverter 110*b* outputs the (N+1)th gate signal G(N+1), and the seventeenth drain electrode and the eighteenth drain electrode receive the low voltage signal.

7. The gate driving circuit of claim 1, if N being equal to one during a plurality of sequential time periods t1, t2 and t3, wherein:

when the previous stage-transmitting signal Q(N−1) is generated during the time period t1, the transition signal TP(N) of the current stage gate driving circuit becomes a low voltage level and the control signal is in a high voltage level, and meanwhile when the latch module turns on, the current inverse stage-transmitting signal XQ(N) is in a high voltage level;

when entering the time period t2 after the previous stage-transmitting signal Q(N−1) during the time period t1 is generated, the first clock signal becomes the low voltage level and the current inverse stage-transmitting signal XQ(N) is in the low voltage level wherein the current stage-transmitting signal Q(1) becomes the high voltage level, and meanwhile when a thirteenth transistor to a sixteenth transistor of the signal processing module in the current stage gate driving circuit turn on, the first stage gate signal G(1) and the second stage gate signal G(2) are generated due to both the second clock signal and the third clock signal;

when the current stage-transmitting signal Q(1) with the high voltage level is formed during the time period t2, the transition signal TP(2) of the next stage gate driving circuit becomes the low voltage level and the control signal SC is in the high voltage level, and when a tenth transistor and an eleventh transistor of the latch module in the next stage gate driving circuit turn on, the first clock signal passes the second inverter and the current inverse stage-transmitting signal XQ(1) with the low voltage level is outputted; and when entering the time period t3 after the current stage-transmitting signal Q(1) during the time period t2 is generated, the first clock signal becomes the high voltage level and the next inverse stage-transmitting signal XQ(2) is in the low voltage level wherein the next stage-transmitting signal Q(2) becomes the high voltage level, and meanwhile when the thirteenth transistor to the sixteenth transistor of the signal processing module in the next stage gate driving circuit turn on, the third stage gate signal G(3) and the fourth stage gate signal G(4) are generated due to both the second clock signal and the third clock signal.

* * * * *